United States Patent [19]

Klygis

[11] Patent Number: 4,848,565

[45] Date of Patent: Jul. 18, 1989

[54] CARRIER DEVICES AND PACKAGES OF CONTAINERS

[75] Inventor: Mindaugas J. Klygis, Barrington, Ill.

[73] Assignee: Illinois Tool Works, Inc., Chicago, Ill.

[21] Appl. No.: 172,537

[22] Filed: Mar. 24, 1988

[30] Foreign Application Priority Data

Mar. 24, 1987 [GB] United Kingdom ..... 8706930

[51] Int. Cl.[4] ..... B65D 71/00

[52] U.S. Cl. ..... 206/150; 294/87.2

[58] Field of Search ..... 206/147, 150, 151, 158, 206/161, 427; 294/87.2

[56] References Cited

U.S. PATENT DOCUMENTS

| | | | |
|---|---|---|---|
| 3,038,602 | 6/1962 | Rapata | 206/150 |
| 3,202,448 | 8/1965 | Stern et al. | 206/151 |
| 3,232,422 | 2/1966 | Whyte | 294/87.2 |
| 3,269,530 | 8/1966 | Wanderer | 206/150 |
| 3,307,321 | 3/1967 | Beart | 206/150 |
| 3,355,013 | 11/1967 | Poupitch | 206/150 |
| 3,374,028 | 3/1968 | Wanderer | 206/150 |
| 3,443,685 | 5/1969 | Wanderer | 206/150 |
| 3,778,096 | 12/1973 | Smith | 206/150 |
| 4,462,494 | 7/1984 | Cunningham | 206/161 |
| 4,471,987 | 9/1984 | Erickson | 206/150 |

FOREIGN PATENT DOCUMENTS

| | | | |
|---|---|---|---|
| 0960217 | 6/1964 | United Kingdom | 294/87.2 |

*Primary Examiner*—Jimmy G. Foster

*Attorney, Agent, or Firm*—Schwartz & Weinrieb

[57] ABSTRACT

A carrier device (1) for connecting together an array of flanged containers (13) comprises a corresponding array of interconnected container encircling bands (2, 3; 5, 6) made from flexible resilient material. Each of the bands (2, 3; 5,6) is elongate and each has a strap (4, 7) extending across it from end to end. The carrier device (1) connects the array of flanged containers (13) together by each band (2, 3; 5, 6) engaging its corresponding container (13) beneath its flange (14) and with each strap (4, 7) extending across the top of the container (13). The strap (4, 7) helps to support the weight of any other packages of containers placed on top of the first containers so as to prevent the second containers from damaging the foil lids (15) of the first containers (13). When the containers (13) include a substantial taper the strap (4, 7) also holds the container encircling band (2, 3; 5,6) at the top of the container (13) immediately adjacent its flange (14).

24 Claims, 2 Drawing Sheets

CARRIER DEVICES AND PACKAGES OF CONTAINERS

BACKGROUND OF THE INVENTION

Field of the Invention

The present invention relates generally to article carriers, and a package of containers supported together by means of the article carrier, and more particularly to an article carrier formed of a suitable plastic material and defined by means of annular band portions which can be expanded so as to engage upper portions of the containers and thereby grip the same in a supporting mode so as to form the package.

Carrier devices for connecting together a plurality of containers so as to form a complete package are widely used especially for connecting together disposable metal cans used for packaging beer and other carbonated beverages. Such cans are generally of a cylindrical configuration with a rolled rim around their top edge. Carrier devices for connecting together such containers comprise an array of interconnected container encircling bands which are made from flexible resilient material and which are stretched so as to elastically grip the top of each can. The bands lie substantially flat against the cylindrical surface of the can and the top edge of each band engages beneath the rolled rim. Such metal cans, particularly when they are filled with pressurized liquids, are substantially rigid and consequently the carrier devices are arranged to tightly grip the tops of the cans so as to maintain the engagement between the carrier device and the cans.

Consumables such as yogurt, other dairy products and prepackaged desserts are often sold in containers made of thermoformed thermoplastic material having a flange extending outwards from the open end thereof and to which a foil lid is attached, usually by adhesive or heat sealing. Such containers are much more flimsy than conventional metal cans and usually include a substantial taper. Accordingly, carrier devices such as those used for cans are unsuitable and, conventionally, to package such containers together in an array, they have been held in a surrounding sleeve of paper or cardboard.

SUMMARY OF THE INVENTION

According to a first aspect of this invention a carrier device for an array of flanged containers comprises a corresponding array of interconnected container encircling bands made from flexible resilient material, each of the bands being elongate and each having a strap extending across it from end to end, whereby in use the carrier device connects an array of flanged containers together with each band engaging its corresponding container beneath its flange and with each strap extending across the top of the container.

According to a second aspect of this invention a package comprises an array of flanged containers and a carrier device having a corresponding array of interconnected container encircling bands made from flexible resilient material, each band having a strap extending across it, each band of the carrier device engaging its corresponding container beneath its flange and each strap extending across the top of the container.

The strap which extends across the top of the flanged end of each container helps to support the weight of any other packages of containers placed on top of the first containers so as to prevent the second containers from damaging the foil lids of the first containers and it also helps to prevent tampering with the foil lids of the first containers. Typically the containers include a substantial taper and, under these circumstances, the strap maintains the container encircling band at the top of the container immediately adjacent its flange. The straps thus enable the container encircling bands to be held in place upon the tapering side walls without the straps having to be engaged so tightly with the side walls of the plastic containers that damage to the containers results.

Preferably each of the elongate container encircling bands before they are applied to the container has a length which is substantially equal to or greater than the diameter or breadth of the containers and a width which is substantially less than the diameter or breadth of the containers. In this way, when the elongate bands are stretched transversely to enable them to pass over the flanged ends of each container the container encircling bands, after being released, contract and grip the top of the container immediately beneath the flanged end of the container. The strap which now has a similar length to the diameter or breadth of the container is stretched across the top of the container and tensioned by being pulled around the edge of the flange towards the side wall of the container immediately beneath the flange.

The container encircling bands may be arranged in a linear array with connecting webs extending between adjacent bands so as to produce a package consisting of a line of individual containers but preferably the container encircling bands are arranged in two or more rows of laterally aligned sets of bands with interconnecting links connecting the bands in the sets together and connecting webs extending between the adjacent bands in each row so that the resulting package has two or more rows of laterally aligned sets of containers. This enables four or six container packages to be readily prepared. Typically the resilient flexible material is formed from a thermoplastic material such as polyethylene.

BRIEF DESCRIPTION OF THE DRAWINGS

A particular example of a carrier device and a package in accordance with this invention will now be described with reference to the accompanying drawings, in which.

DESCRIPTION OF PREFERRED EXAMPLES

Figure 1:
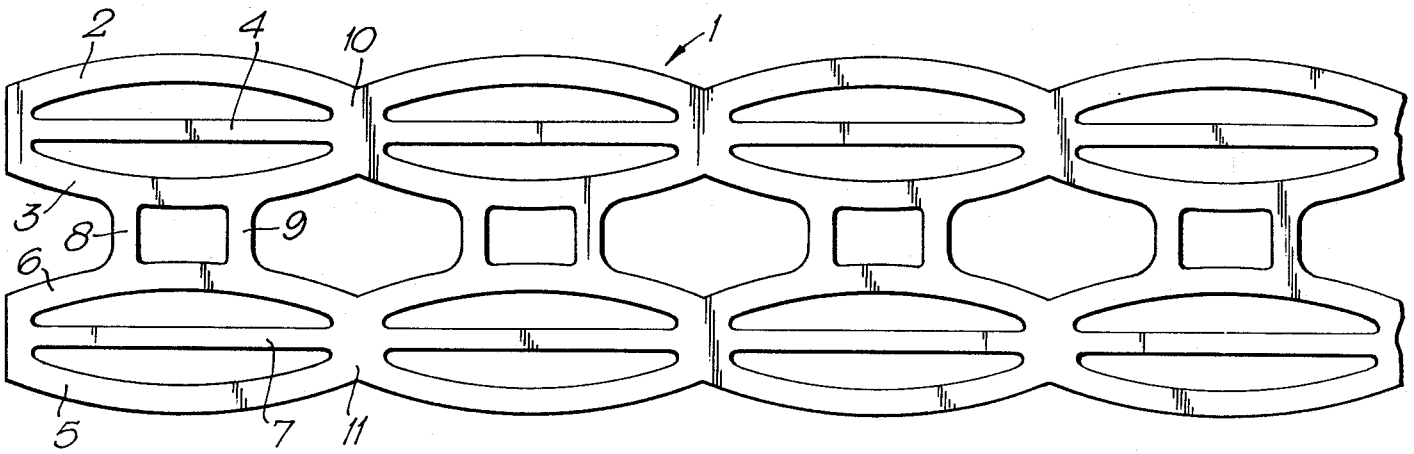
FIG. 1 is a plan view of a continuous strip of carrier devices before application thereof to a plurality of containers to be packaged thereby; and, FIG. 2 is a perspective view of a completed package.

A continuous web of resilient plastic sheeting such as polyethylene is punched so as to produce a stock carrier device 1 as shown in FIG. 1. The stock 1 comprises a repetitive pattern consisting of curved strips 2 and 3 which together, form a generally elliptical container encircling band. A strap 4 extends across the middle of each elliptical band formed by the curved strips 2 and 3. Beside the band formed by the strips 2 and 3 and the strap 4, there is also provided a substantially identical pair of curved strips 5 and 6 and a strap 7. The curved strips 3 and 6 are joined together by means of connecting links 8 and 9 which extend in a transverse direction across the carrier stock 1. Successive pairs of container encircling bands are joined together by means of connecting webs 10 and 11 so as to form a continuous strip of the carrier stock 1 with the adjacent pairs of container encircling bands in each transverse row being generally aligned in the longitudinal direction of the carrier stock 1.

In use a stock applicator having two pairs of jaws which are movable with respect to each other enters the apertures formed between the curved strips 2 and 3 and the strap 4 and between the curved straps 5 and 6 and strap 7. As the jaws are moved apart the container encircling bands formed by the strips 2 and 3 and 5 and 6 are transversely expanded and fitted over a flanged end of a container so that the container encircling band formed by means of the strips 2 and 3 and 5 and 6 surround the side wall of the container adjacent its flanged end whilst the straps 4 and 7 extend across the top of the flanged end of the container.

Figure 2:
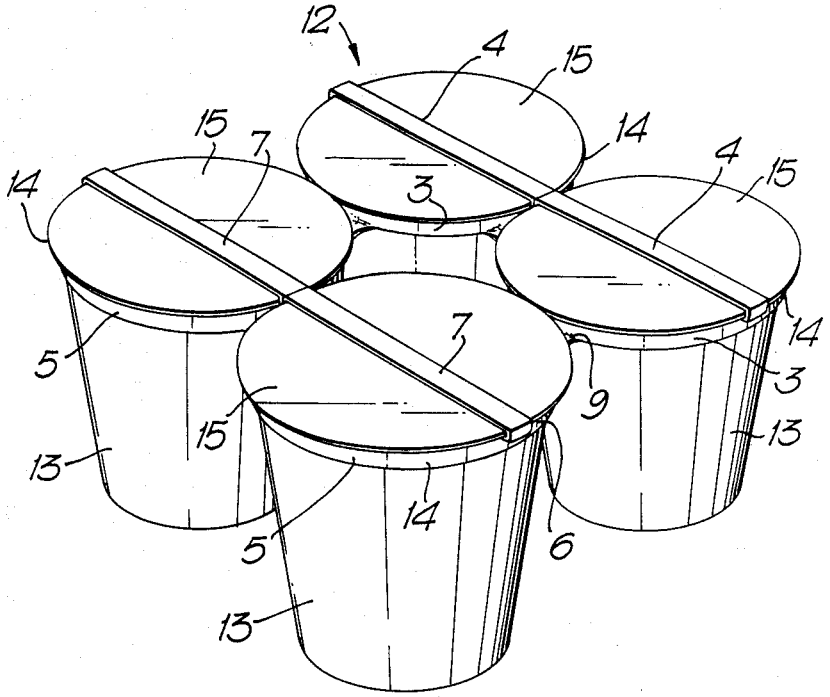

FIG. 2 illustrates a completed four container package 12 and shows four identical frusto conically configured thermoformed thermoplastic containers 13 each having a flanged end 14 to which is heat sealed a foil lid 15. The container encircling bands formed by means of the curved strips 2, 3, 5 and 6 are shown engaged around the top of the side wall of each of the containers 13 immediately under the flange 14 with the straps 4 and 7 extending across the top surface of the lids 15 of the containers. The container encircling bands around each container are joined to one another by means of the connecting webs 10 and 11 and the connecting links 8 and 9 so as to hold the four containers together in a square array.

Obviously, many variations and modifications of the present invention are possible in light of the above teachings. It is therefore to be understood that within the scope of the appended claims, the present invention may be practiced otherwise than as specifically described herein.

I claim:

1. A carrier device for an array of flanged containers, comprising:

a corresponding array of interconnected container-encircling bands, made from flexible resilient material, for connecting said array of flanged containers together with each of said bands engaging its corresponding container beneath its flange;

each of said bands having a substantially elliptical configuration as defined by means of a longitudinally extending major axis and a laterally extending minor axis with the length of said bands as defined in a direction extending along said major axis being substantially greater than the diametrical extent of said containers while the width of said bands as defined in a direction extending along said minor axis being substantially less than the diametrical extent of said containers such that upon application of said carrier device upon said array of flanged containers, each of said bands will be radially expanded in said width direction and radially contracted in said length direction so as to permit said bands to be applied to said containers and to engage said containers with a predetermined amount of force; and a strap extending across each one of said container encircling bands along said major axis of each band so as to extend across the top of each one of said containers and over said flange of each one of said containers so as to maintain said container-encircling bands upon said containers within the vicinity of said flanged portions of said containers.

2. The carrier device of claim 1, wherein said container encircling bands are arranged in a linear array and said carrier device also includes connecting webs extending between adjacent bands so as to produce a package consisting of a line of individual containers.

3. The carrier device of claim 2, wherein said resilient flexible material is polyethylene.

4. The carrier device of claim 1, wherein said container encircling bands are arranged in at least two rows of laterally aligned sets and said carrier device includes interconnecting links connecting the bands in said sets together and connecting webs extending between and connecting together adjacent bands in each of said rows whereby said package has at least two rows of laterally aligned sets of containers.

5. A carrier device as set forth in claim 4, wherein:

each of said sets of bands defined within each of said rows of bands comprises at least four bands whereby said carrier device defines a two-by-four array of said bands for housing at least eight containers.

6. A carrier device as set forth in claim 4, wherein:

each of said sets of bands defined within each of said rows of bands comprises at least two bands whereby said carrier device defines a two-by-two array of said bands for housing at least four containers.

7. The carrier device of claim 4, wherein said resilient flexible material is polyethylene.

8. A package, comprising:

an array of flanged containers each one of which is formed from a thermoformed thermoplastic material; and a carrier device defining a corresponding array of interconnected container-encircling bands, made from flexible resilient material, for connecting said array of flanged containers together with each of said bands engaging its corresponding container beneath its flange, each of said bands having a substantially elliptical configuration as defined by means of a longitudinally extending major axis and a laterally extending minor axis with the length of said bands as defined in a direction extending along said major axis being substantially greater than the diametrical extent of said containers while the width of said bands as defined in a direction extending along said minor axis being substantially less than the diametrical extent of said containers such that upon application of said carrier device upon said array of flanged containers, each of said bands will be radially expanded in said width and radially contracted in said length direction so as to permit said bands to be applied to said containers and to engage said containers with a predetermined amount of force sufficient to support said containers yet which will not cause radial deformation and collapse of said thermoformed thermoplastic containers; and a strap extending across each one of said container encircling bands along said major axis of each band so as to extend across the top of each one of said containers and over said flange of each one of said containers so as to maintain said container-encircling bands upon said containers within the vicinity of said flanged portions of said containers.

9. The package of claim 8, wherein said container encircling bands are arranged in a linear array and said carrier device also includes connecting webs extending between adjacent bands so as to produce a package consisting of a line of individual containers.

10. The package of claim 8, wherein said resilient flexible material is polyethylene.

11. The package of claim 8, wherein said container encircling bands are arranged in at least two rows of laterally aligned sets and said carrier device includes interconnecting links connecting the bands in said sets together and connecting webs extending between and connecting together adjacent bands in each of said rows whereby said package has at least two rows of laterally aligned sets of containers.

12. The package of claim 11, wherein said resilient flexible material is polyethylene.

13. A package as has been set forth in claim 11, wherein:

each of said sets of bands defined within each of said rows of bands comprises at least four bands whereby said carrier device defines a two-by-four array of said bands for housing at least eight containers.

14. A package as has been set forth in claim 11, wherein:

each of said sets of bands defined within each of said rows of bands comprises at least two bands whereby said carrier device defines a two-by-two array of said bands for housing at least four containers.

15. A package as set forth in claim 8, wherein:

said containers each have a tapered configuration substantially in the form of a truncated cone with the largest diameter portion thereof disposed uppermost and defining the flanged portion of each of said containers.

16. A package, comprising:

an array of flanged containers each one of which has a foil lid disposed atop thereof; and a carrier device defining a corresponding array of interconnected container-encircling bands, made from flexible resilient material, for connecting said array of flanged containers together with each of said bands engaging its corresponding container beneath its flange, each of said bands having a substantially elliptical configuration as defined by means of a longitudinally extending major axis and a laterally extending minor axis; and a strap extending across each one of said container-encircling bands along said major axis of each band so as to extend across the top of each one of said containers and over said flange of each one of said containers so as to maintain said container-encircling bands upon said containers within the vicinity of said flanged portions of said containers, and to protect said foil lids disposed atop said containers from damage and tampering.

17. A package as set forth in claim 16, wherein:

the length of said bands as defined in a direction extending along said major axis is substantially greater than the diametrical extent of said containers while the width of said bands as defined in a direction extending along said minor axis is substantially less than the diametrical extent of said containers, whereby upon application of said carrier upon said array of flanged containers, each of said bands will be radially expanded in said width direction and radially contracted in said length direction so as to permit said bands to be applied to said containers and to engage said containers with a predetermined amount of force sufficient to support said containers.

18. A package as set forth in claim 16, wherein:

said container encircling bands are arranged in a linear array; and said carrier device further includes connecting webs extending between adjacent bands so as to produce a package consisting of a line of individual containers.

19. A package as set forth in claim 16, wherein:

said resilient flexible material is polyethylene.

20. A package as set forth in claim 16, wherein:

said container encircling bands are disposed in at least two rows of laterally spaced sets; and said carrier device includes interconnecting links connecting said bands in said sets together, and connecting webs extending between and connecting together adjacent bands in each of said rows, whereby said package has at least two rows of laterally spaced sets of containers.

21. A package as set forth in claim 20, wherein:

each of said sets of bands defined within each of said rows of bands comprises at least four bands whereby said carrier device defines a two-by-four array of said bands for housing at least eight containers.

22. A package as set forth in claim 20, wherein:

each of said sets of bands defined within each of said rows of bands comprises at least two bands whereby said carrier device defines a two-by-two array of said bands for housing at least four containers.

23. A package as set forth in caim 16, wherein:

said containers are formed from thermoformed thermoplastic material.

24. A package as set forth in claim 16, wherein:

said containers have a tapered configuration substantially in the form of a truncated cone with the largest diameter portion thereof disposed uppermost and defining the flanged portion of each of said containers.

* * * * *